US006151950A

United States Patent [19]

Wilhelm et al.

[11] Patent Number: 6,151,950

[45] Date of Patent: Nov. 28, 2000

[54] HAND PRESSING TOOL FOR CRIMPING LEAD END SLEEVES

[75] Inventors: Edgar Wilhelm, Altersbach; Horst Hofmann, Unterschoenau, both of Germany

[73] Assignee: Rennsteig Werkzeuge GmbH, Viernau/Thueringen, Germany

[21] Appl. No.: 09/296,731

[22] Filed: Apr. 22, 1999

[30] Foreign Application Priority Data

Apr. 24, 1998 [DE] Germany ..... 198 18 482

[51] Int. Cl.[7] ..... H01R 43/042

[52] U.S. Cl. ..... 72/409.01; 72/416; 29/751

[58] Field of Search ..... 72/409.01, 409.12, 72/409.13, 409.14, 413, 416; 29/751; 81/419

[56] References Cited

U.S. PATENT DOCUMENTS

| | | | |
|---|---|---|---|
| 2,947,207 | 8/1960 | Demler | 72/416 |
| 3,001,426 | 9/1961 | Demler | 72/416 |
| 3,244,201 | 4/1966 | Wallshein . | |
| 3,576,122 | 4/1971 | Churla | 72/409.14 |
| 3,710,610 | 1/1973 | McCaughey | 72/409.16 |
| 4,353,240 | 10/1982 | Undin | 72/409.12 |
| 4,604,890 | 8/1986 | Martin | 72/416 |
| 5,913,933 | 6/1999 | Beetz | 72/409.16 |

FOREIGN PATENT DOCUMENTS

| | | | |
|---|---|---|---|
| 21 49 167 | 9/1976 | Germany . | |
| 25 48 901 | 10/1976 | Germany . | |
| 27 55 482 C2 | 8/1987 | Germany . | |
| 33463 | 9/1912 | Sweden | 72/416 |

*Primary Examiner*—Daniel C. Crane
*Attorney, Agent, or Firm*—Michael J. Striker

[57] ABSTRACT

A hand crimping tool for crimping and notching of sleeve connectors, such as lead end sleeves and the like for electrical conductors has a head composed of flat part, a pressing unit arranged between the parts and composed of a relatively fixed pressing jaw and a pressing jaw which is movable relative to the fixed pressing jaw, both the pressing jaws being provided with a pressing profile, lateral cover plates which form the head and provides full-surface guiding and covering the pressing jaws, the cover plates extending approximately to a front end side of the head, at least one of the cover plates in a symmetry region of the pressing profile of the pressing jaws being provided laterally with a window-shape, forwardly open recess, the both pressing jaws in their laterally accessible regions having an acting profile with tooth tips which are removed by a predetermined value X and laterally open and accessible.

5 Claims, 2 Drawing Sheets

FIG.3
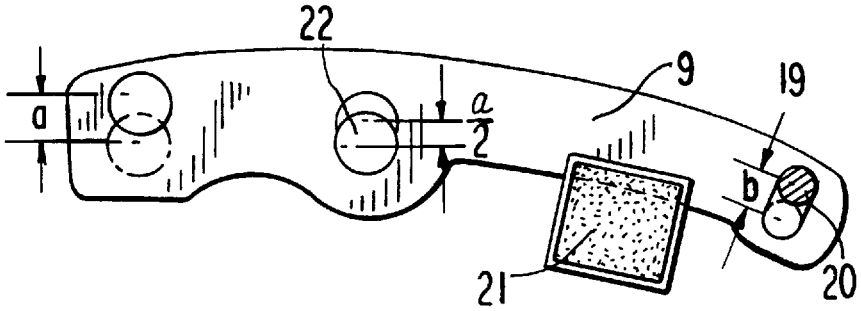
FIG.4
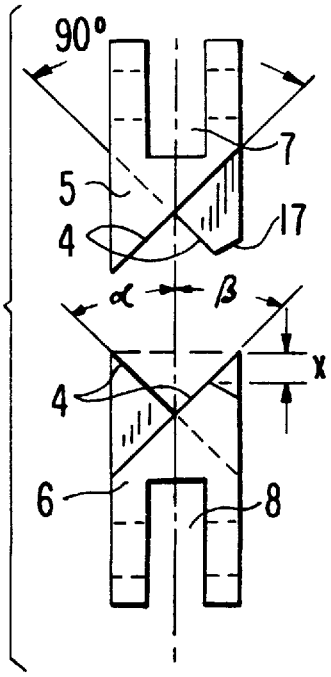
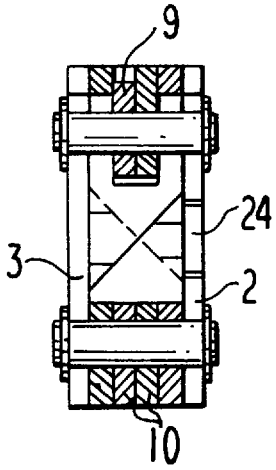
FIG.5

HAND PRESSING TOOL FOR CRIMPING LEAD END SLEEVES

BACKGROUND OF THE INVENTION

The present invention relates to a hand pressing tool for crimping or notching of sleeve connectors, such as lead and sleeves and the like for electrical conductors.

More particularly, it relates to hand pressing pliers which has a head composed of plane, plate-shaped parts, and a comb-like pressing block composed of a fixed and turnable pressing jaw and arranged between these parts.

For applying and connecting of sleeve connectors especially formed of lead end sleeves, on the cable ends, hand operated pressing pliers are utilized. They are provided with fixed or exchangeable pressing jaws which are arranged in pairs, are movable relative to one another in a pliers-like manner and formed as a notch block. With this tool, the shape-forming crimping of the sleeve bodies with individual strands or isolated cable wires is performed for the lead end sleeves inserted between the pressing jaws. This is disclosed for example in the German patent document DE-PS 21 49 167.

The pressing jaws which in a known manner are mounted on the mouth jaws of the pliers and approach one another in pliers-like way so as to close and form together a pressing die, are provided with profiled webs which engage one another in a comb-like fashion. The prepressing or precrimping of the lead end sleeves is performed between the profiled webs. This is disclosed for example in the German patent document DE-OS 25 48 901.

The arrangement and functional construction of the pressing block is selected so that the lead end sleeves to be crimped are introduced axially, or in other words in the end side of the pressing tool. During closing of the pressing jaws they are compressed and on several axially successive locations are crimped by offset and interengaging profiled webs. This is disclosed in the German patent document DE OS 27 55 482.

These tools are advantageously utilized for many crimping applications. When however it is necessary to perform crimping in narrow space conditions such as frequently in switching cabinets, switch boxes and the like, it is exceptionally difficult if not completely impossible to bring the pressing pliers with regard to the cable ends with the fitted-on lead end sleeves to working and pressing position in the switching cabinets at locations which are difficult to access.

This is in particular true since with the known types of the pliers an axial movement onto the cable end to be pressed is possible, whereby the insertion opening can not be seen and it is left to an accident to crimp the lead end sleeves, which are arranged loosely on the wire strand, in a proper position. In addition, the design of the tool head with respect to the precision of precrimping remains to be desired.

SUMMARY OF THE INVENTION

Accordingly, it is an object of the present invention to provide hand pressing tool of the above mentioned general type, in which the pressing jaws have improved guidance and stable lateral hold so that a lateral deviation under the influence of the pressing forces acting during shaping of the material are excluded and pressing of displaced four-edge crimps is prevented.

It is an also an objective of the present invention to form the pliers as small as possible and thereby more convenient to handle, and simultaneously however to expand the pressing region when compared with known tools. In particular, two pressing regions, namely from 0.08–6 qmm and 6–10 qmm are selectable and adjustable in order to avoid the necessity to have available several pliers for these pressing regions to make a precrimping with only one hand pressing tool in accordance with the present invention. For this purpose, a perfectly adjustable support of the turnably movable pressing jaws for fixing the corresponding pressing region is required.

It is an also an objective of the present invention to provide a desired adjusting possibility for the different pressing regions on the corresponding transmission members and for the springy support of the turnably movable pressing jaws and to provide their arrangement in the tongue system in agreeable, advantageous and space consuming manner.

These objectives are achieved with the use of the new features of the present invention. With the hand pressing tool in accordance with the present invention, the desired complete functionality, simplicity and easiness to operate and the improved working effects are achieved. A substantial quality improvement for producing a square pressing profile with the previously described comb profile is obtained when the outer surface of the pressing die is executed in high gloss polish whereby the pressing profile slides and less lead end sleeve material is displaced in the hollow space of the pressing profile.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 3 is a schematic side view of a transmission lever shown in FIG. 1, with illustration of a possible adjusting path in articulation points;

FIG. 4 is a front view of both pressing jaws with a one-side shortened comb profile, on an enlarged scale; and FIG. 5 is a front view of a hand part of the pliers, as seen in section 1—1 in FIG. 1.

DESCRIPTION OF PREFERRED EMBODIMENTS

Figure 1:
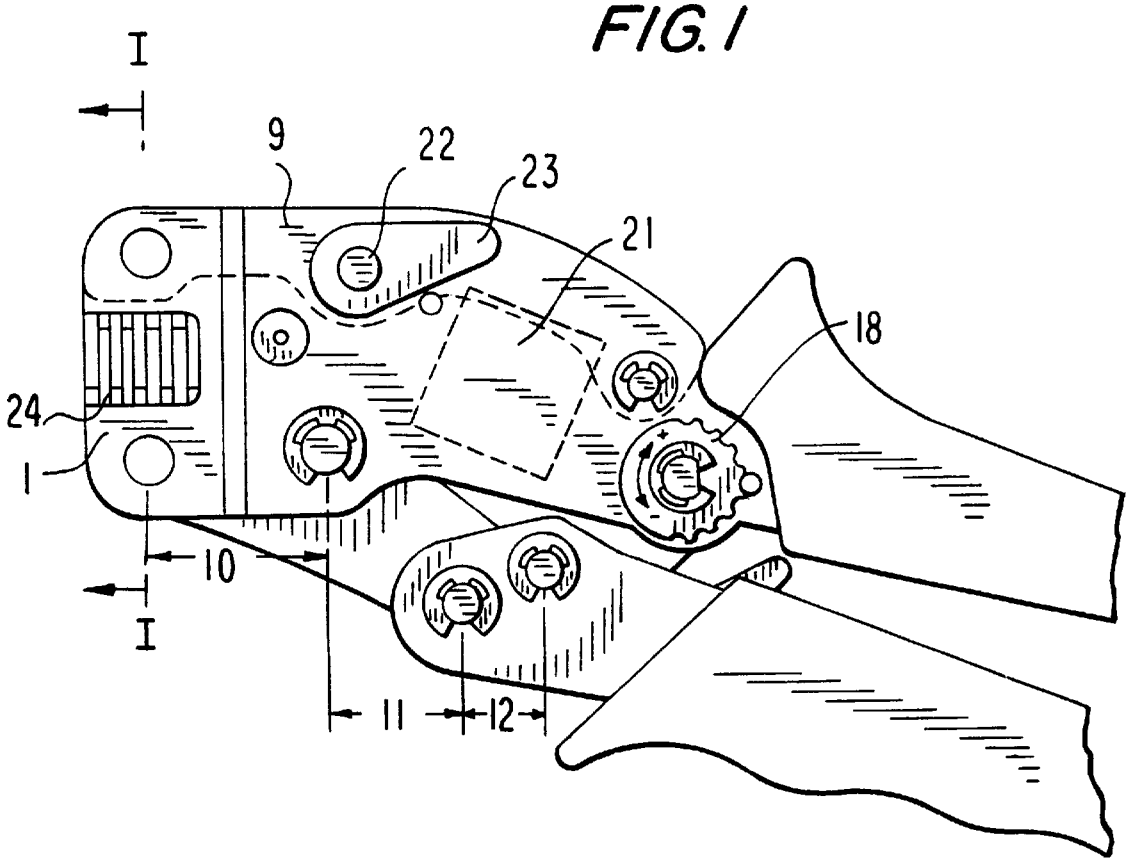
FIG. 1 is a schematic side view of hand pressing pliers with a closed pressing block, on a scale substantially 1:1.

A hand pressing tool in accordance with the present invention as shown in FIGS. 1–5, is formed as pliers and has a head 1 which is composed substantially of two lateral cover plates 2 and 3. Pressing jaws 5 and 6 are laterally enclosed by and slidingly guided on inner surfaces of the cover plates 2 and 3 and carry a pressing profile 4. Longitudinal grooves 7 and 8 provide for a form-locking reception and reliable holding of the pressing jaws 5 and 6 at their adjacently articulated functional points of the pliers. The upper pressing jaw 5 is force-transmittingly connected with a transmission lever 9 as shown in FIG. 3. The lower pressing jaw 6 as shown in FIG. 1 is in a force-transmitting operative connection with a drive lever 10 of the pliers, which belongs to the vectorially represented toggle lever region 10, 11, 12.

Figure 2:
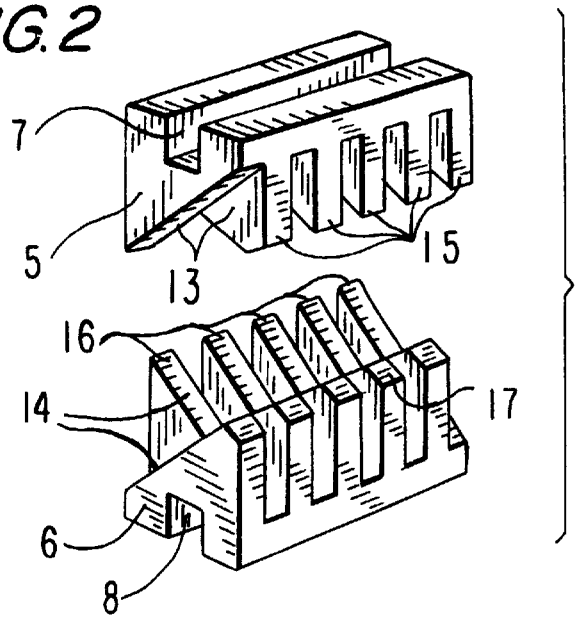
FIG. 2 is a schematic view showing both pressing jaws which carry a pressing profile, with one-side shortened comb profile on upper and lower jaws on an enlarged scale.

As can be seen from FIG. 2, each pressing jaw 5 and 6 has two groups of engaging or active surfaces 13 and 14. Teeth 15 and 16 are formed on these surfaces and engage with one another in a comb-like manner. Intermediate spaces are formed between two neighboring teeth. During closing of the tongues the teeth of the opposite jaw engage in the intermediate spaces, so that the end sleeve inserted in the receiving prism form by the teeth shape and representing the pressing profile 4 is provided in a known manner with a four-time or four-surface acting crimping.

In accordance with one feature of the present invention, preferably, the teeth 15 and 16 of the pressing jaws 5 and 6 are shortened at one longitudinal side, or the teeth tips are removed inclinedly by a predetermined value "X" as shown in FIGS. 2 and 4. Thereby it is possible to insert the lead end sleeve prepared for prepressing laterally into the pressing profile 4 of the pliers to perform the pressing. This is of a great advantage especially in working spaces which are narrow and difficult to access. For facilitating the introducing or inserting of the lead end sleeve into the interior of the pliers, the shortened tooth tips are provided with outwardly inclined surfaces 17 as shown in FIG. 4.

In the crimping pliers of the type to which the present invention belongs, there is a functional requirement to perform crimping of different size lead end sleeves or conductor cross-sections with a single-size tool. It would be thereby possible to avoid a stock of several different tool sizes.

In many cases, for example during pressing of contact elements of any type on the ends of the electrical conductors it is necessary, depending on the size of the working objects, to operate with a greater force than in the case of relatively small cross-sections for recrimping. Also, the force which acts on the corresponding contact element, for example a lead end sleeve when the drive element formed as the transmitting lever approaches its end position with closing pressing jaws, must be greater with greater cross-sections than with smaller ones.

The inventive arrangement and design of the transmitting lever 9 which supports the upper, relatively fixed pressing jaw 5 corresponds to this functional requirement. In FIG. 1 it is shown in its operative position and in FIG. 3 it is shown and described with the subsequent clarifications with respect to its nominal path. From the practical considerations, it is accepted that the prepressing of three cross-sectional sizes must be provided, namely 0–4 qmm, 4–6 qmm and 6–10 qmm.

First the basic adjustment of the pliers is provided, which is performed through an adjusting eccentric 18 provided for the toggle lever. Simultaneously, the adjustment of the working hardness of the fixed abutment which acts on the transmission lever 9 is performed. It is formed as a connection of the abutment pin 19—elongated hole 20 and is shown in FIG. 3.

A blocking spring 21, for example formed of polyurethane is arranged between the transmitting lever 9 and the fixed abutment which is formed by the abutment pin 19 with the elongated hole 20. In some cases it is mounted with pre-tensioning. It operates so that in the event of small cross-sections it measures the pressing force acting on the working object before the safety block of the pliers opens. In the case of greater pressing cross-sections it represents a part of the pressing counter force, until the pressing process is ended at the so-called fixed abutment.

An adjustable eccentric pin 22 is arranged at the central hinge point of the transmission lever 9. The relative position of the transmission lever 9 is changeable by the eccentric pin 22 with the help of a foldable lever 23 as shown in FIG. 3. This adjustment, preferably by the half of the available pressing path "A" required at the pressing jaws is needed to provide in the case of the greater pressing cross-section such as 10 qmm, a sufficiently great pressing path at the pressing jaws.

These adjusting paths are shown for clear illustration of conditions available at the transmission lever 9 in FIG. 3. It can be seen that with pressing cross-sections 6 qm and 10 qm, as pressing counter forces the blocking spring 21 plus the fixed abutment are operated before the pressing ends, and the pliers open again by overcoming of the lock which is not shown in the drawings.

A window-like recess 24 which is open toward the front end of the tool end is provided in the cover plate 2, laterally in a symmetry region of the pressing profile 4 of the pressing jaws 5, 6. This is shown in FIGS. 1 and 5. Due to this recess, the lead sleeve to be pressed which is equal or smaller than 2.5 qmm can be inserted into the pressing profile 4 from the side.

In accordance with a prior art, the pressing profiles are formed 4-edge symmetrically, while the total angle in FIG. 4 amounts always to 90° and the angle $\alpha$ and $\beta$ amount to 45° .

The clamping points at the connection clamps, because of their small distances relative to one another are formed partially rectangular to be space economical. In order to satisfy this requirement, the pressing profiles must obtain rectangular shape. This objective of the invention is achieved where a displaced pressing profile is realized. In particular, the angle $\alpha$ and $\beta$ are not completed to be 45° to 45° but instead have a value of approximately $\alpha$=50° and $\beta$=40°. The thereby occurring different side pressures are taken up by lateral cover plates 2 and 3 without problems.

It will be understood that each of the elements described above, or two or more together, may also find a useful application in other types of constructions differing from the types described above.

While the invention has been illustrated and described as embodied in hand pressing tongues for crimping lead end sleeves, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand crimping tool for crimping and notching of sleeve connectors, for electrical conductors, comprising a head composed of flat parts; a pressing unit arranged between said parts and composed of a relatively fixed pressing jaw and a pressing jaw which is movable relative to said fixed pressing jaw, both said pressing jaws being provided with a pressing profile; lateral cover plates which form said head and provides full-surface guiding and covering of said pressing jaws, said cover plates extending approximately to a front end side of said head, at least one of said cover plates in a symmetry region of said pressing profile of said pressing jaws being provided laterally with a window-shape, forwardly open recess, said both pressing jaws in their laterally accessible regions having an acting profile having tooth tips which are removed by a predetermined value X and laterally open and accessible; a two-arm transmission lever having a force arm and a loading arm; and a spring element formed as a blocking spring, one of said relatively fixed pressing jaws being articulately connected with said two-arm transmission lever, said two-arm transmission lever being movably supported on an eccentric pin, said force arm and said loading arm of said transmission lever being turnable relative to one another, and said loading arm being supported on said spring element, while said relatively fixed pressing jaw is associated with said force arm, said transmission lever in its central portion being displaceable due to said eccentric pin for adjustment to different pressing cross-sections.

2. A hand crimping tool as defined in claim 1, wherein said pressing profile is formed as an asymmetrical profile.

3. A hand crimping tool as defined in claim 1, wherein said pressing profile is provided on active pressing surfaces and has a high gloss polish.

4. A hand crimping tool as defined in claim 1, wherein said recess at both sides is formed in said cover plates.

5. A hand crimping tool for crimping and notching of sleeve connectors, such as lead end sleeves and the like for electrical conductors, comprising a head composed of flat parts; a pressing unit arranged between said parts and composed of a relatively fixed pressing jaw and a pressing jaw which is movable relative to said fixed pressing jaw, both said pressing jaws being provided with a pressing profile; lateral cover plates which form said head and provides full-surface guiding and covering of said pressing jaws, said cover plates extending approximately to a front end side of said head, at least one of said cover plates in a symmetry region of said pressing profile of said pressing jaws being provided laterally with a window-shape, forwardly open recess, said both pressing jaws in their laterally accessible regions having an acting profile with tooth tips which are removed by a predetermined value X and laterally open and accessible; and a two-arm transmission lever which is turnableon an eccentric pin, said transmission lever being arranged between said cover plates and said head and adjustable in a central portion by said eccentric pin; a spring element formed as a blocking spring and arranged in an interior of said pliers, said relatively fixed pressing jaw being formed on a force arm of said transmission lever, while a loading arm is formed on said spring element; and an abutment pin-elongated hole connection, said loading arm being turnably articulated on said abutment pin-elongated hole connection.

* * * * *